US012203677B2

(12) United States Patent
He

(10) Patent No.: US 12,203,677 B2
(45) Date of Patent: Jan. 21, 2025

(54) AIR CONDITIONER HOUSING ASSEMBLY AND AIR CONDITIONER

(71) Applicants: GD MIDEA AIR-CONDITIONING EQUIPMENT CO., LTD., Guangdong (CN); MIDEA GROUP CO., LTD., Guangdong (CN)

(72) Inventor: Bowen He, Guangdong (CN)

(73) Assignees: GD MIDEA AIR-CONDITIONING EQUIPMENT CO., LTD., Guangdong (CN); MIDEA GROUP CO., LTD., Guangdong (CN)

( * ) Notice: Subject to any disclaimer, the term of this patent is extended or adjusted under 35 U.S.C. 154(b) by 215 days.

(21) Appl. No.: 17/956,324

(22) Filed: Sep. 29, 2022

(65) Prior Publication Data

US 2023/0042382 A1 Feb. 9, 2023

Related U.S. Application Data

(63) Continuation of application No. PCT/CN2020/104866, filed on Jul. 27, 2020.

(30) Foreign Application Priority Data

Apr. 30, 2020 (CN) ..... 202020715345.6

(51) Int. Cl.
*F24F 13/20* (2006.01)
*F24F 1/0323* (2019.01)
*F24F 1/04* (2011.01)

(52) U.S. Cl.
CPC ..... *F24F 13/20* (2013.01); *F24F 1/0323* (2019.02); *F24F 1/04* (2013.01)

(58) Field of Classification Search
CPC .. F24F 13/20; F24F 1/04; F24F 1/0323; F24F 2013/202; F24F 2013/205
See application file for complete search history.

(56) References Cited

U.S. PATENT DOCUMENTS 3,907,050 A * 9/1975 Mullings ..... F24H 9/02 62/297
4,912,940 A * 4/1990 Anderson ..... B60H 1/3227 62/297

(Continued)

FOREIGN PATENT DOCUMENTS

CN 1598414 A 3/2005
CN 101377344 A 3/2009

(Continued)

OTHER PUBLICATIONS

Supplementary European Search Report dated Aug. 8, 2023 received in European Patent Application No. EP 20933687.4.

(Continued)

*Primary Examiner* — Nelson J Nieves
(74) *Attorney, Agent, or Firm* — Scully, Scott, Murphy & Presser, P.C.

(57) ABSTRACT

An air conditioner housing assembly and an air conditioner are provided. The air conditioner housing assembly has a chassis for bearing a weight of the air conditioner. An enclosure plate of the assembly is fixed to an upper side of the chassis, and the enclosure plate extends in an up-down direction and is distributed around a periphery of the chassis. A housing of the assembly is fixed to the enclosure plate or the chassis, or both. An inner side of the housing is enclosed with the upper side of the chassis to form a containing space. The enclosure plate is located on the inner side of the housing. The enclosure plate is provided with a positioning portion, and the housing is provided with a positioning fit portion. The positioning portion is matched with the positioning fit portion to position the housing through the enclosure plate.

13 Claims, 8 Drawing Sheets

(56) References Cited

U.S. PATENT DOCUMENTS

| | | | | | |
|---|---|---|---|---|---|
| 5,669,230 | A * | 9/1997 | Bruce | F24F 1/027 | 62/288 |
| 5,685,166 | A * | 11/1997 | Li | F25D 23/006 | 62/428 |
| 5,943,873 | A * | 8/1999 | Chung | F24F 13/20 | 62/262 |
| 11,226,118 | B1 * | 1/2022 | Rodriguez | F24F 13/20 | |
| 11,293,653 | B1 * | 4/2022 | Burnett | F24F 8/00 | |
| 2004/0144117 | A1 * | 7/2004 | Kim | F24F 13/20 | 62/262 |
| 2005/0039480 | A1 * | 2/2005 | Kim | F24F 1/027 | 62/262 |
| 2007/0170827 | A1 * | 7/2007 | Frenia | F24F 1/005 | 312/265.5 |
| 2008/0302120 | A1 * | 12/2008 | Kang | F04D 25/064 | 62/259.1 |
| 2009/0077988 | A1 * | 3/2009 | Ishikawa | F24F 1/22 | 62/515 |
| 2009/0158935 | A1 * | 6/2009 | Kim | F24F 13/28 | 96/189 |
| 2011/0274568 | A1 * | 11/2011 | Chiu | F24F 3/1405 | 417/410.1 |
| 2014/0117825 | A1 * | 5/2014 | Lee | G06F 15/161 | 312/309 |
| 2017/0343258 | A1 * | 11/2017 | Yamaguchi | F24F 13/222 | |
| 2018/0023821 | A1 * | 1/2018 | Kim | F24F 13/222 | 62/264 |
| 2018/0274797 | A1 * | 9/2018 | Kim | F24F 1/0022 | |
| 2020/0061231 | A1 * | 2/2020 | Jeong | B01D 46/64 | |
| 2020/0182508 | A1 * | 6/2020 | Bae | F24F 13/10 | |
| 2020/0200429 | A1 * | 6/2020 | Qin | F24F 13/20 | |
| 2020/0278122 | A1 * | 9/2020 | Zhou | F24F 13/08 | |
| 2020/0292204 | A1 * | 9/2020 | Jang | F24F 13/30 | |
| 2020/0326078 | A1 * | 10/2020 | Satou | F24F 13/20 | |
| 2022/0316720 | A1 * | 10/2022 | Li | F24F 3/1405 | |
| 2023/0003397 | A1 * | 1/2023 | Liu | F24F 1/027 | |
| 2024/0151410 | A1 * | 5/2024 | Gao | F24F 13/20 | |

FOREIGN PATENT DOCUMENTS

| | | | | |
|---|---|---|---|---|
| CN | 102466314 | A | | 5/2012 |
| CN | 203518171 | U | | 4/2014 |
| CN | 104214849 | A | | 12/2014 |
| CN | 106440322 | A | | 2/2017 |
| CN | 207334968 | U | | 5/2018 |
| CN | 208253792 | U | | 12/2018 |
| JP | 57172120 | A | * | 4/1981 |
| JP | 57172123 | A | * | 4/1981 |
| JP | 58002532 | A | * | 6/1981 |

OTHER PUBLICATIONS

International Search Report and Written Opinion dated Feb. 1, 2021 received in International Application No. PCT/CN2020/104866.

* cited by examiner

AIR CONDITIONER HOUSING ASSEMBLY AND AIR CONDITIONER

CROSS-REFERENCE TO RELATED APPLICATIONS

The present application is a continuation application of PCT International Patent Application No. PCT/CN2020/104866, filed on Jul. 27, 2020, which claims priority to and benefits of Chinese Patent Application No. 202020715345.6, entitled "Air Conditioner Housing Assembly and Air Conditioner", and filed on Apr. 30, 2020. The entire contents of the aforementioned applications are incorporated in this application by reference for all purposes. No new matter has been introduced.

FIELD

The present application relates to the field of air conditioners, and in particular, to an air conditioner housing assembly and an air conditioner.

BACKGROUND

A traditional air conditioner housing usually includes a chassis, and a plurality of plates fixed to the upper side of the chassis. When the air conditioner is being assembled, the heat exchange components inside the air conditioner are mounted on the chassis, and subsequently the plurality of plates are fixed to each other to cover the chassis. However, the plate of this air conditioner housing is usually made of a plastic material, so the strength of the air conditioner housing is lower, resulting in an easy deformation of the air conditioner during transportation and being stacked. Moreover, multiple plates are difficultly positioned when they are fixed to each other, so the assembly efficiency is lower, and after the assembly is completed, the plates may be deformed and uncoordinated, the strength and anti-deformation of the air conditioner housing are further weakened.

The above is only used to assist in understanding the technical solution of the present application and may not constitute prior art.

SUMMARY

According to an aspect of the disclosure, an air conditioner housing assembly is provided. The air conditioner housing assembly includes:

a chassis;

an enclosure plate fixed to an upper side of the chassis, the enclosure plate extending in an up-down direction and being distributed around a periphery of the chassis; and a housing fixed to the enclosure plate and/or the chassis, an inner side of the housing being enclosed with the upper side of the chassis to form a containing space, the enclosure plate being located on the inner side of the housing, the enclosure plate is provided with a positioning portion, the housing is provided with a positioning fit portion, and the positioning portion is matched with the positioning fit portion, to position the housing through the enclosure plate.

In an embodiment, the housing is made of a plastic material, and the enclosure plate is made of a metal material.

In an embodiment, a projection of the chassis in the up-down direction is rectangular, the rectangular projection has a front edge and a rear edge extending in a horizontal direction, two side edges extending in a front-rear direction between the front edge and the rear edge, the enclosure plate includes two side enclosure plates and a rear enclosure plate, and each side enclosure plate is provided at each side edge, and the rear enclosure plate is provided at the rear edge.

In an embodiment, the housing includes an upper plate fixed to an upper side of the enclosure plate, a front plate fixed to the chassis and the two side enclosure plates, a rear plate fixed to the rear enclosure plate, each side of the front plate in the horizontal direction is provided with a side plate rearwardly extending, each side of the rear plate in the horizontal direction is provided with a side plate forwardly extending, and a side plate of the front plate is in abutment with a side plate of the rear plate in the front-rear direction.

In an embodiment, the positioning portion includes a first positioning slot provided at an upper side of each side enclosure plate and a plurality of second positioning slots provided at an upper side of the rear enclosure plate, the plurality of second positioning slots are distributed at intervals in a length direction of the rear enclosure plate, the positioning fit portion includes a positioning protrusion provided at each end of the upper plate in the horizontal direction and a plurality of positioning studs provided at a rear side of the upper plate, and each positioning protrusion is matched with each first positioning slot, and each positioning stud is matched with each second positioning slot.

In an embodiment, the first positioning slot and the second positioning slot are each of a v-shaped groove with an upward opening.

In an embodiment, each end of the upper plate is provided with a positioning support member protruding in the horizontal direction, each end of the chassis is provided with a positioning support member protruding in the horizontal direction, each side of the front plate in the horizontal direction is provided with a support fit member, and the positioning support member is matched with the support fit member to limit the front plate.

In an embodiment, the positioning support member is clamped to and is matched with the support fit member.

In an embodiment, the side plate of one of the front plate and the rear plate is provided with a clamping portion, the side plate of the other of the front plate and the rear plate is provided with a clamping fit portion, and the clamping portion is matched with the clamping fit portion, to make the rear plate be clamped to the front plate.

In an embodiment, the front side of the upper plate is provided with a plurality of positioning grooves, an upper end of the front plate and/or the rear plate is provided with a plurality of positioning bumps, and each positioning bump is inserted in each positioning groove.

In an embodiment, the air conditioner housing assembly further includes: a spacer plate. The spacer plate is provided in the containing space and fixed to the enclosure plate to divide the containing space into an upper containing cavity and a lower containing cavity, one of side plates of the rear enclosure plate is provided with an accommodation cavity for a remote controller, the spacer plate at the mounting port is provided with an avoidance groove corresponding to the mounting port, the side enclosure plate is provided with an avoidance notch corresponding to the mounting port, and the rear enclosure plate is provided with the avoidance notch corresponding to the mounting port.

According to another aspect of the disclosure, an air conditioner is provided. The air conditioner includes an air conditioner housing assembly as described above.

In an embodiment, the air conditioner is a mobile air conditioner.

In an embodiment, the air conditioner further includes a heat exchanger with a metal side plate. The enclosure plate is made of a metal material, the enclosure plate is screwed with the metal side plate, and the enclosure plate has a grounding structure.

The air conditioner housing assembly of the present application includes a chassis; an enclosure plate fixed to an upper side of the chassis, extending in an up-down direction and distributed around a periphery of the chassis; and a housing fixed to the enclosure plate and/or the chassis, an inner side of the housing is enclosed with the upper side of the chassis to form a containing space, the enclosure plate is located on the inner side of the housing. The enclosure plate is provided with a positioning portion, the housing is provided with a positioning fit portion, the positioning portion is matched with the positioning fit portion, and the housing is positioned through the enclosure plate. In the present application, the inner side of the housing is reinforced by using the enclosure plate, to improve the overall strength of the air conditioner, and after the housing is pre-positioned by using the enclosure plate when the air conditioner housing assembly is assembled, the housing is fixed to the enclosure plate or the chassis by such as screws, etc., the operation is simple and it is not easy to misalignment, the assembly efficiency and assembly accuracy of the air conditioner are improved.

BRIEF DESCRIPTION OF THE DRAWINGS

In order to more clearly illustrate the technical solutions in the embodiments of the present application or the related art, the drawings in the description of the embodiments or the related art will be simply introduced below, it is obvious that the drawings described below are only some of the embodiments of the present application, other drawings can be obtained by those skilled in the art according to the structures shown in these drawings without any creative labor.

Figure 1:
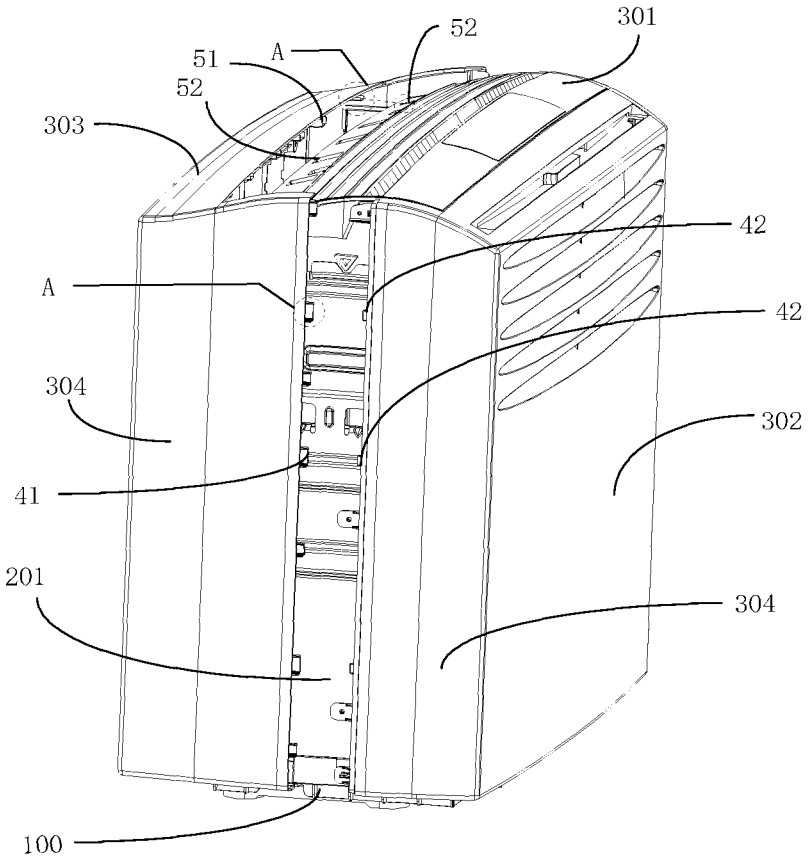
FIG. 1 is a schematic three-dimensional structure view of an air conditioner provided in the present application, in which a rear plate is separated.
Figure 2:
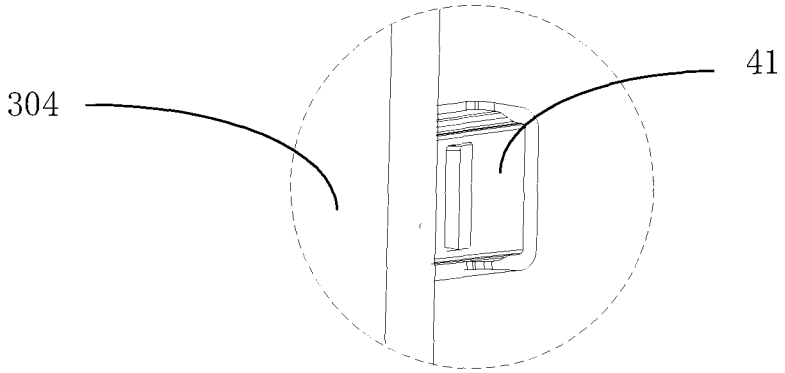
FIG. 2 is an enlarged view at A position in FIG. 1.

Reference numerals appearing in the figures are described in the following table.

| Reference | Name | Reference | Name |
|---|---|---|---|
| 100 | chassis | 11 | first positioning slot |
| 101 | front edge | 12 | second positioning slot |
| 102 | rear edge | 21 | positioning protrusion |
| 103 | side edge | 22 | positioning stud |
| 201 | side enclosure plate | 31 | positioning support member |
| 202 | rear enclosure plate | 32 | support fit member |
| 301 | upper plate | 41 | clamping portion |
| 302 | front plate | 42 | clamping fit portion |
| 303 | rear plate | 51 | positioning groove |
| 304 | side plate | 52 | positioning bump |
| 400 | spacer plate | 500 | heat exchanger |
| 401 | avoidance groove | 501 | metal plate |
| 300 | avoidance notch | 600 | accommodation cavity for a remote controller |

The realization of the purpose, functional features and advantages of the present application will be further described with reference to the drawings in conjunction with the embodiments.

DETAILED DESCRIPTION OF EMBODIMENTS

It should be noted that if there are directional indications (such as up, down, left, right, front, rear) in the embodiments of the present application, all directional indications are only used to explain relative position relationships, movement, etc. among components in a particular posture (as shown in drawings), and if the particular posture is changed, the directional indication changes accordingly.

In addition, if the terms "first", "second", etc. appear in an embodiment of the present application, the terms "first", "second", etc. are only used for descriptive purposes, and cannot be understood as indicating or implying its relative importance or implicitly specifying the number of technical features indicated. Thus, features defined with "first", "second" may explicitly or implicitly include at least one such feature. In addition, "and/or" throughout the text includes three parallel solutions, for example, "A and/or B" includes A, or B, or A and B.

In the present application, an up-down direction refers to a direction perpendicular to a horizontal direction. The description of the orientation of each component in the air conditioner housing assembly in the present application applies to the orientation of the air conditioner in the normal use state after the air conditioner housing assembly is assembled, and does not apply to the orientation of the air conditioner during production, assembly or transportation.

The present application discloses an air conditioner housing assembly used with an air conditioner. The air conditioner can be a wall-mounted air conditioner, a window air conditioner, a mobile air conditioner, and the like.

Referring to FIGS. 1 to 12, the air conditioner housing assembly includes a chassis 100, enclosure plates 201, 202 and a housing formed by elements 301, 302 and 303. The chassis 100 is used to carry the weight of the overall air conditioner, specifically to carry each heat exchange component and the control component in the air conditioner, including an air duct worm, a compressor, a motor, an electric control cabinet, and the like. Generally, an upper side of the chassis 100 can also be provided with a water catch basin for collecting condensate water generated by the air conditioner during working. The enclosure plate is fixed to the upper side of the chassis 100, extends in the up-down direction, and is distributed around a periphery of the chassis 100, i.e., distributed around an inner periphery of the chassis 100 and near an edge of the chassis 100. In an embodiment, the enclosure plate may be provided fully around the periphery of the chassis 100, or may extend partially around the periphery of the chassis 100. In an embodiment, the enclosure plate is made of a material with better strength and anti-deformation than the material of the housing. The housing may be made of a plastic material, and the enclosure plate is made of a metal material. The housing is fixed to the enclosure plate and/or the chassis 100. An inner side of the housing is enclosed together with an upper side of the chassis 100 to form a containing space. The containing space is used to accommodate components (such as, heat exchange components of the air conditioner), and the enclosure plate is located on the inner side of the housing. In this way, the enclosure plate can fasten and strengthen the housing. The enclosure plate is provided with a positioning portion and the housing is provided with a positioning fit portion, and the positioning portion is matched with the positioning fit portion, so that the housing is positioned through the enclosure plate. In the present application, the inner side of the housing is reinforced by the enclosure plate, to improve overall strength of the air conditioner, and after the housing is pre-positioned by the enclosure plate when the air conditioner housing assembly is being assembled, the housing is fixed to the enclosure plate or the chassis 100 by such as screws, etc., the operation is simple and it is not easy to misalignment, the assembly efficiency and assembly accuracy of the air conditioner are improved.

The chassis 100 can be of various shapes, considering the structure of the general air conditioner. In the embodiment, referring to FIGS. 1, 3 and 12, a projection of the chassis 100 in the up-down direction is rectangular, the rectangular projection has a front edge 101 and a rear edge 102 extending in a horizontal direction, which is an extension direction of a long edge of the chassis 100, and two side edges 103 extending in a front-rear direction between the front edge and the rear edge, the front-rear direction is an extension direction of the short edge of the chassis 100. The enclosure plate includes two side enclosure plates 201 and a rear enclosure plate 202, each side enclosure plate 201 is provided at each side edge 103, and the rear enclosure plate 202 is provided at the rear edge 102. The side enclosure plate 201 and the rear enclosure plate 202 both are fixed to the chassis 100. In an embodiment, the side enclosure plate 201 and the rear enclosure plate 202 can be fixed to each other to strengthen the overall structure of the air conditioner. The enclosure plate can be used to fix the housing, and can also be used to mount an evaporator, a condenser, an air duct worm housing and the like, so that the heat exchange components and the like. in the air conditioner are no longer limited to being fixed to the chassis 100, but can be overlayed and distributed in the up-down direction. Thus, the floor area of the air conditioner is reduced. In the embodiment, the enclosure plate is distributed around three sides of the chassis 100, so that during assembling the air conditioner, the assembler can operate from the open front side and the upper side of the enclosure plate, the operation is easy and the assembly efficiency is high.

Figure 3:
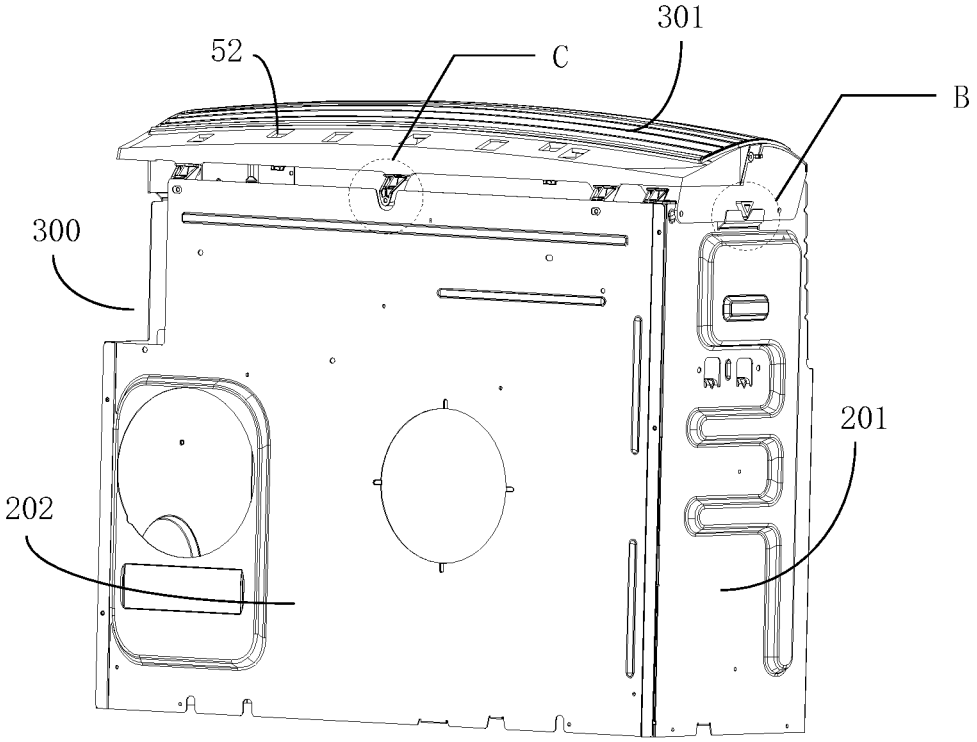
FIG. 3 is a schematic three-dimensional structure view of the air conditioner of FIG. 1, in which the rear plate and the side plate are removed.
Figure 4:
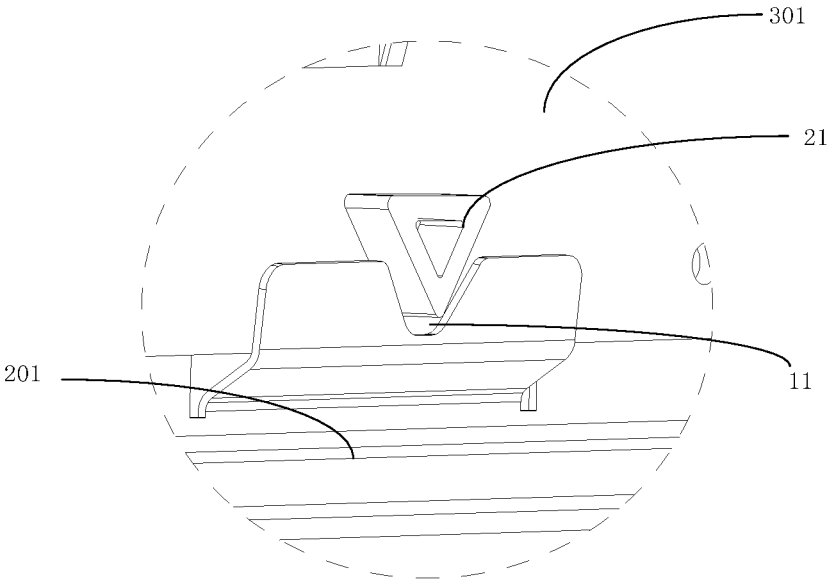
FIG. 4 is an enlarged view at B position in FIG. 3.
Figure 5:
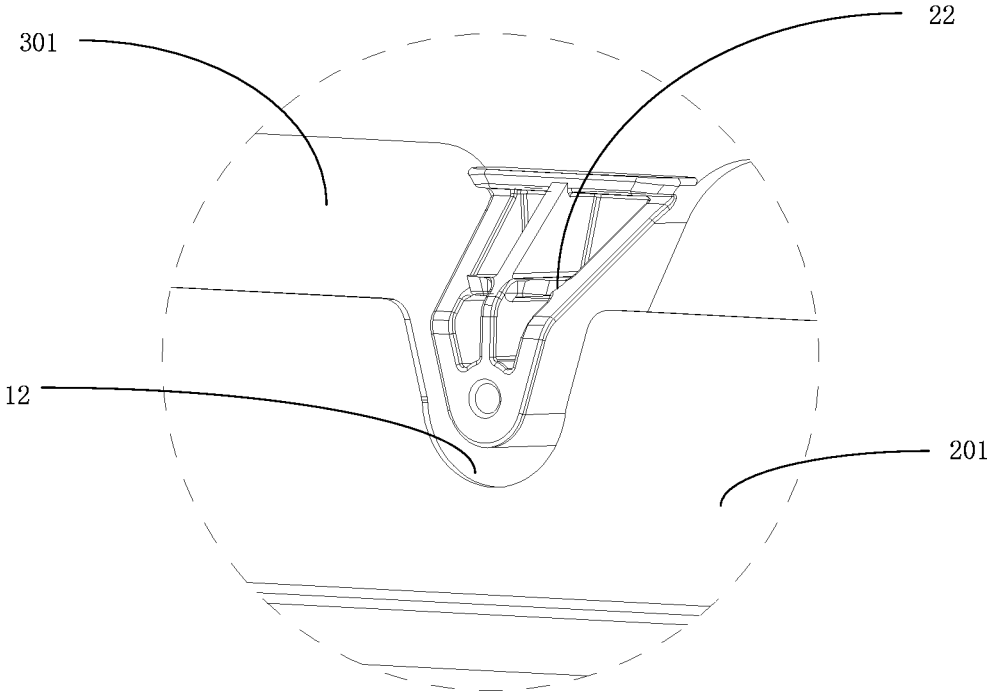
FIG. 5 is an enlarged view at C position in FIG. 3.
Figure 12:
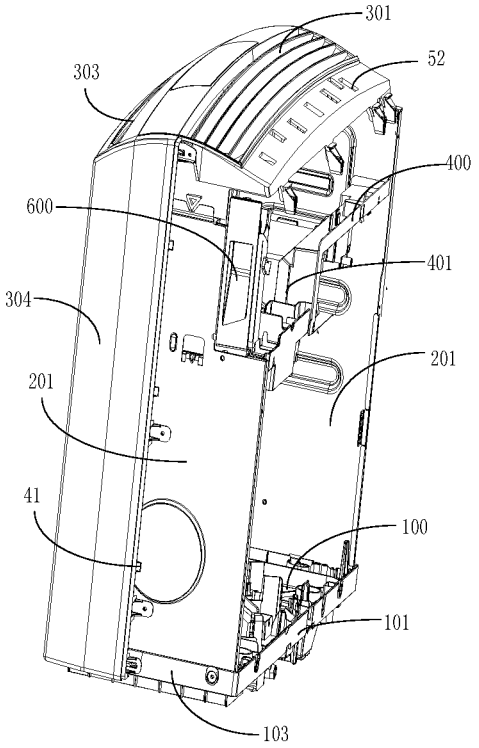
FIG. 12 is a schematic three-dimensional structure view of the air conditioner of FIG. 7, in which the rear plate, the side plates and the rear enclosure plate are removed.
Figure 13:
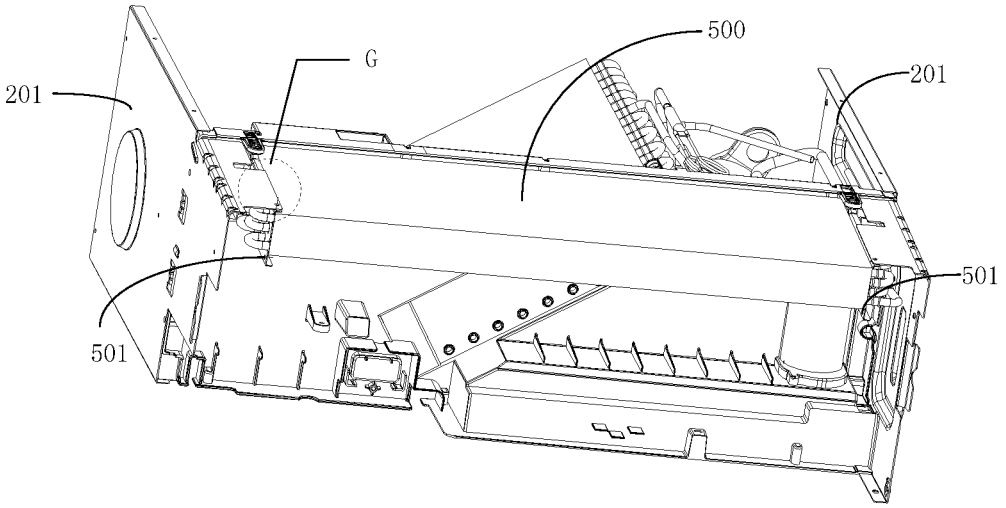
FIG. 13 is a connection schematic view of the heat exchanger and the side enclosure plate within the air conditioner in FIG. 1.
Figure 14:
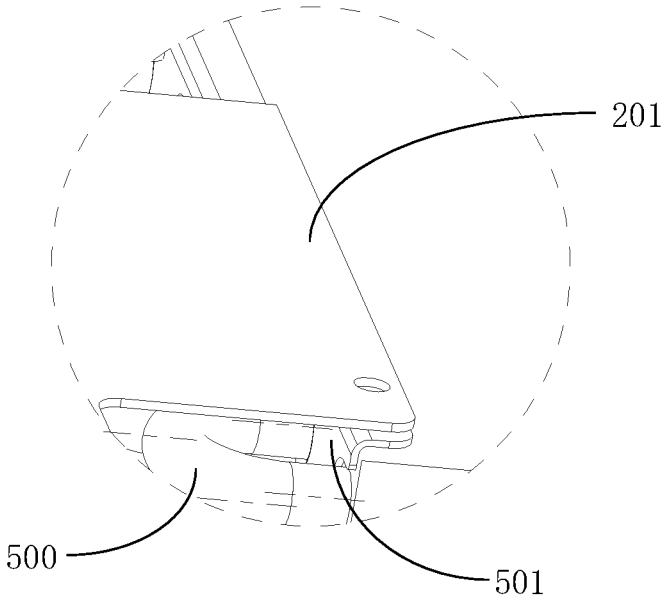
FIG. 14 is an enlarged view at G position in FIG. 13.

In an embodiment, referring to FIGS. 1, 3 and 12, the housing includes an upper plate 301 fixed to an upper side of the enclosure plate, a front plate 302 fixed to the chassis 100 and the two side enclosure plates 201, and a rear plate 303 fixed to the rear enclosure plate 202. Each of two sides of the front plate 302 in the horizontal direction is provided with a side plate 304 rearwardly extending, each of two sides of the rear plate 303 in the horizontal direction is provided with a side plate 304 forwardly extending, and side plates 304 of the front plate 302 and the rear plate 303 are docked to each other in the front-rear direction. In this way, the upper plate 301, the front plate 302, the rear plate 303 and the chassis 100 are jointly enclosed to form a containing space. In the embodiment, the upper plate 301, the front plate 302 and the rear plate 303 that make up the housing are directly or indirectly fixed to the enclosure plate. The screws can be used to strengthen the air conditioner housing and facilitate positioning and assembly, and the assembly efficiency is improved. In addition, the front plate 302 and the rear plate 303 are docked to each other through side plates 304 to achieve the enclosure of both sides of the housing of the air conditioner in the horizontal direction, the separate side plate is omitted, the number of plates is reduced and the assembly efficiency of the air conditioner is improved.

In the process of fixing the upper plate 301 to the enclosure plate, in order to improve the assembly efficiency and assembly accuracy, the upper plate 301 is pre-positioned by the cooperation of the positioning portion and the positioning fit portion, and then the upper plate 301 is fixed to the enclosure plate, for example, by screws. In this embodiment, referring to FIGS. 3 to 5, the positioning portion includes a first positioning slot 11 on the upper side of each side enclosure plate 201, and a second positioning slot 12 on the upper side of the rear enclosure plate 202. The first positioning slot 11 and the second positioning slot 12 are each of a v-shaped slot with an upward opening. There are a plurality of the second positioning slot 12, and the plurality of the second positioning slot 12 are distributed at intervals in the length direction of the rear enclosure plate 202. The positioning fit portion includes a positioning protrusion 21 at two ends of the upper plate 301 in the horizontal direction, and a plurality of positioning stud 22 at the rear side of the upper plate 301. Each positioning protrusion 21 is matched with each first positioning slot 11 and each positioning stud 22 is matched with each second positioning slot 12. In this way, when the upper plate 301 is being assembled, the upper plate 301 is firstly clamped to the upper side of the enclosure plate, each positioning protrusion 21 is fit into each first positioning slot 11 from the upper side, and each positioning stud 22 is correspondingly fit into each second positioning slot 12 to pre-position the upper plate 301, and then the upper plate 301 is screwed to the rear enclosure plate 202 to fix the upper plate 301, the operation is simple, the connection is reliable and the assembly efficiency is high.

In an embodiment, when the front plate 302 is being assembled, it also will be fixed after pre-positioning. In an embodiment, referring to FIGS. 7 to 9, the upper plate 301 and the chassis 100 are provided with positioning support members 31 at each end in the horizontal direction, and the front plate 302 is provided with support fit members 32 on each side in the horizontal direction, and the positioning support members 31 fit the support fit members 32 to limit the front plate 302. In one embodiment, the positioning support member 31 and the support fit member 32 are clamped to each other, so that when the front plate 302 is installed, the front plate 302 is pushed from front-to-back to a space between the chassis 100 and the upper plate 301, and the positioning support member 31 is matched with the support fit member 32 to pre-position the front plate 302, and then the front plate 302 is fixed to the chassis 100 and the side enclosure plate 201, for example, by screws, to fix the front plate 302. Thus, the operation is simplified, the connection is reliable and the assembly accuracy is high.

In an embodiment, when the rear plate 303 is being assembled, it also will be fixed after pre-positioning. In an embodiment, referring to FIGS. 1, 2, 10 and 11, one of the side plates 304 of the front plate 302 and the rear plate 303 is provided with a clamping portion 41, and the other side plate 304 of the front plate 302 and the rear plate 303 is provided with a clamping fit portion 42, and the clamping portion 41 is matched with the clamping fit portion 42 to make the rear plate 303 to be clamped to the front plate 302. In this way, the fixed front plate 302 is used to pre-position the rear plate 303, and then the rear plate 303 is fixed to the rear enclosure plate 202, for example, by screws, to fix the rear plate 303, the operation is simple, the connection is reliable and the assembly accuracy is high.

Figure 6:
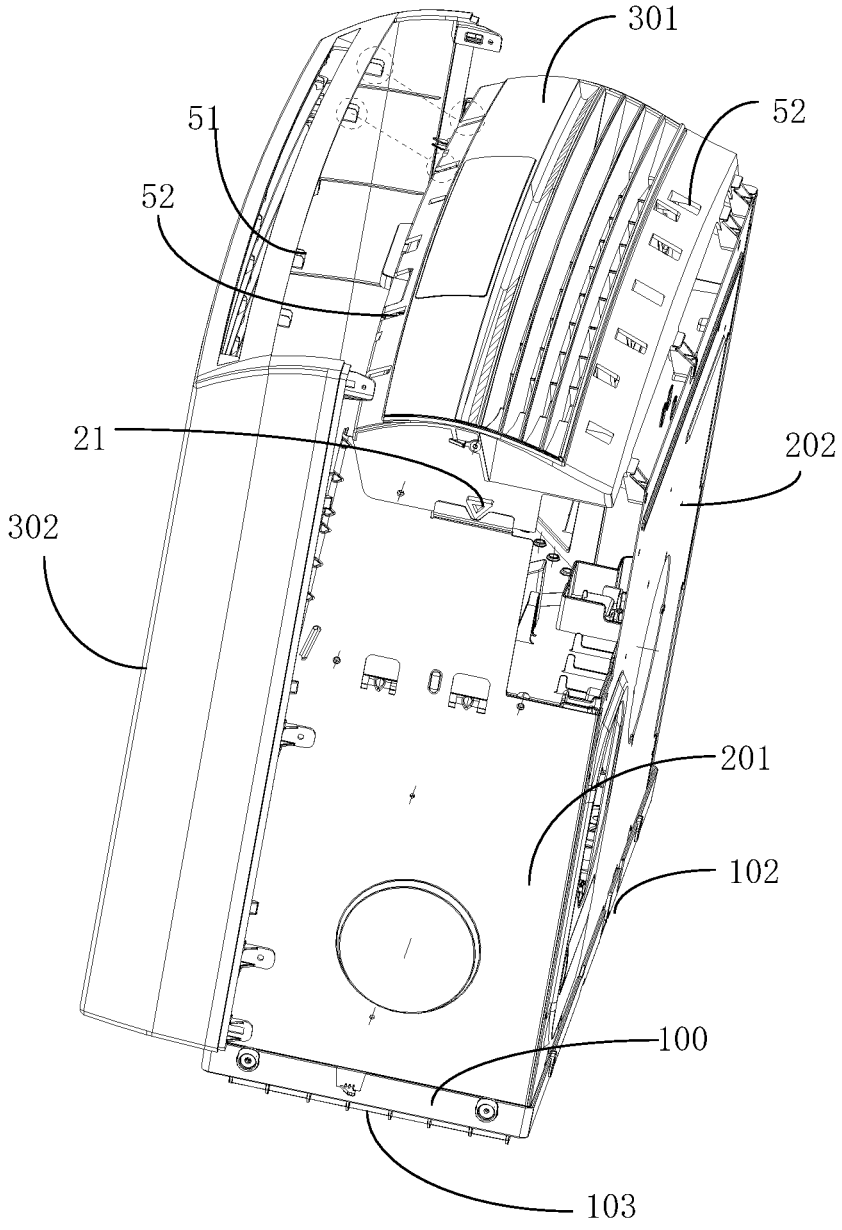
FIG. 6 is a schematic three-dimensional structure view of the air conditioner in FIG. 1, in which the rear plate and the side plate are removed and the front plate is moved away.

In an embodiment, in order to further improve the positioning accuracy of the front plate 302 and the rear plate 303, referring to FIGS. 1 and 6, the front side of the upper plate 301 is provided with a plurality of positioning grooves 51, and the upper end of the front plate 302 and/or the rear plate 303 are correspondingly provided with a plurality of positioning bumps 52, each positioning bump 52 is inserted in each positioning groove 51. In this way, the front plate 302 and the rear plate 303 are positioned by using the upper plate 301. During operation, as long as the front plate 302 or the rear plate 303 is mounted at the correct angle, each positioning bump 52 can automatically fit each positioning groove 51, and the operation is convenient. The above structure increases the restriction points and force points of the front plate 302 and/or the rear plate 303, to more accurately position the front plate 302 and the rear plate 303, and to strengthen the connection between the upper plate 301 and the front plate 302 and the connection between the upper plate 301 and the rear plate 303. Thus, the performance of the air conditioner housing can be improved.

Figure 7:
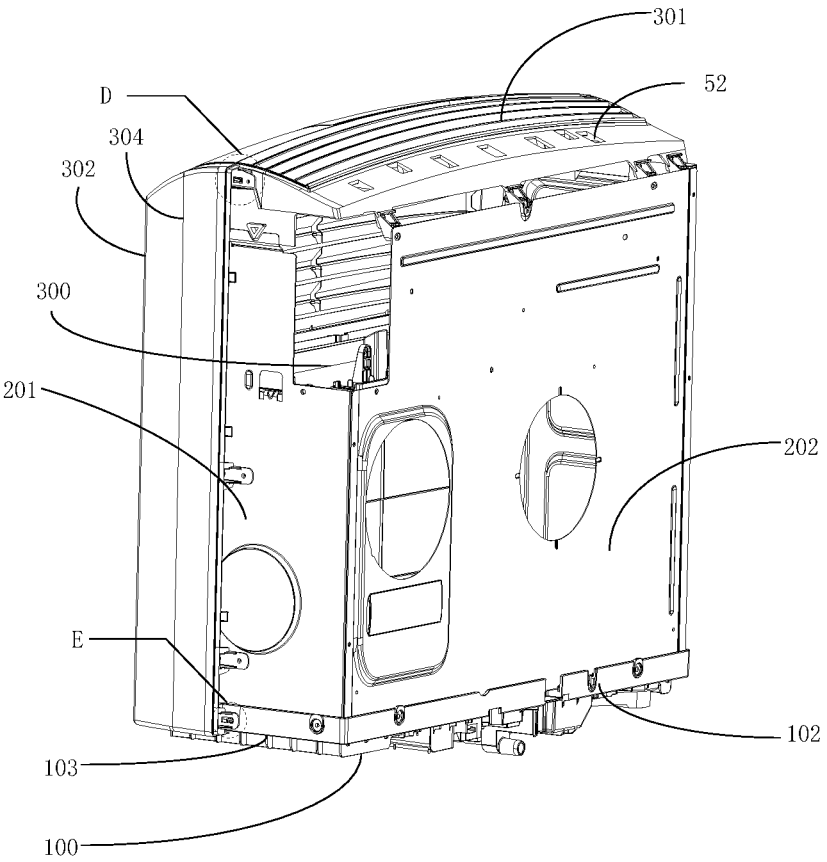
FIG. 7 is a schematic three-dimensional structure view of the air conditioner in FIG. 6 from another perspective, in which the front plate is assembled.
Figure 8:
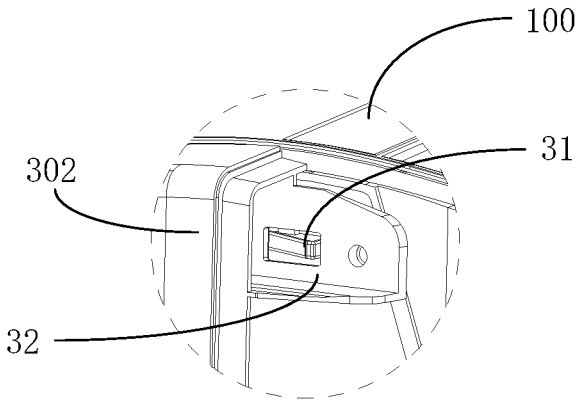
FIG. 8 is an enlarged view at D position in FIG. 7.
Figure 9:
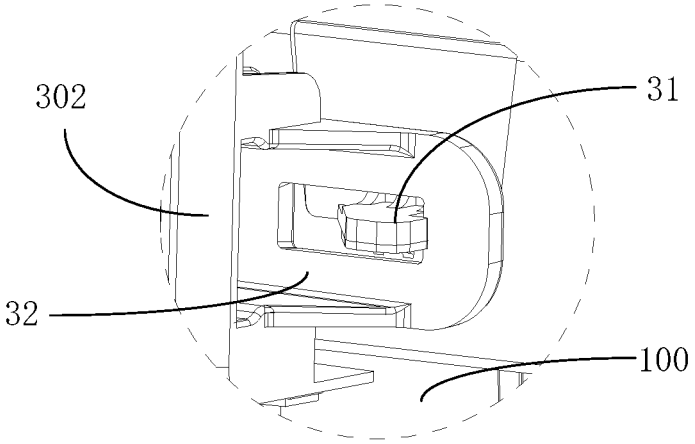
FIG. 9 is an enlarged view at E position in FIG. 7.
Figure 10:
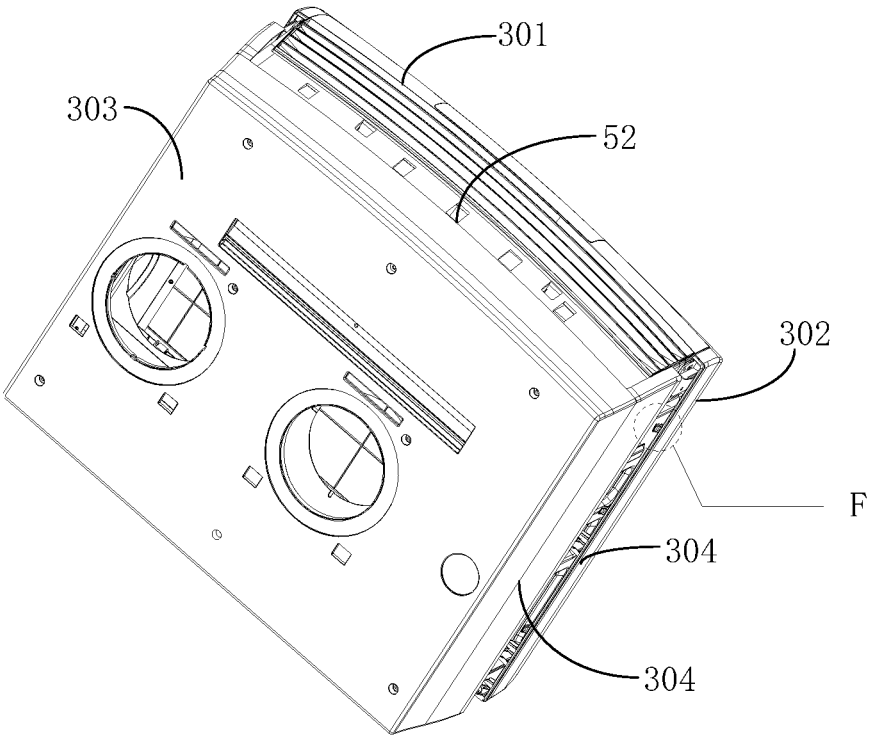
FIG. 10 is a schematic three-dimensional structure view of the air conditioner in FIG. 1 from another perspective, in which the rear plate is assembled.
Figure 11:
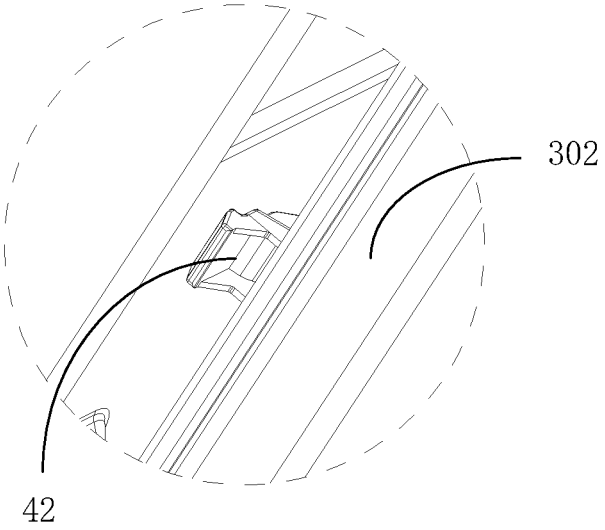
FIG. 11 is an enlarged view at F position in FIG. 10.

In an embodiment, referring to FIGS. 6, 7 and 12, the air conditioner housing assembly further includes a spacer plate 400, which is provided in the containing space and fixed to the enclosure plate to divide the containing space into an upper containing cavity and a lower containing cavity, and a mounting port for a remote controller is opened on one of the side plates 304 of the rear enclosure plate 202, and the spacer plate 400 at the mounting port is provided with an avoidance groove 401 corresponding to the mounting port, and each of the side enclosure plate 201 and the rear enclosure plate 202 is provided with an avoidance notch 300 corresponding to the mounting port. In this way, an accommodation cavity 600 for the remote controller is formed on an outer wall of an assembled air conditioner for accommodating the remote controller.

The present application also provides an air conditioner, which includes an air conditioner housing assembly, the specific structure of the housing assembly refers to the above-mentioned embodiments. Since the air conditioner adopts all technical solutions of the above-mentioned embodiments, it has at least all the beneficial effects brought by the technical solutions of the above-mentioned embodiments, which will not be repeated herein.

In an embodiment, the air conditioner is a mobile air conditioner, and because the air conditioner has an enclosure plate, the overall strength of the air conditioner is strengthened, and the heat exchange components and the like, in the air conditioner are no longer limited to being fixed to the chassis 100, but can also be fixed to the enclosure plate, so that they can be overlayed and distributed in the up-down direction, the floor area of the air conditioner is reduced and it is conductive to transporting and containing the mobile air conditioner.

In an embodiment, the enclosure plate is made of a metal material, and the air conditioner also includes a heat exchanger 500, which has a metal side plate 501, and the enclosure plate is screwed to the metal side plate 501, and the enclosure plate has a grounding structure. The heat exchanger 500 can be an evaporator, a condenser, and the like. In an embodiment, the heat exchanger 500 is the evaporator, each end of the evaporator in the horizontal direction is provided with a metal side plate 501, and the metal side plate 501 is screwed to both sides of the side enclosure plate 201. In this way, on the one hand, the evaporator can play a role of positioning for fixing; on the other hand, when the enclosure plate is provided with a grounding structure, the enclosure plate can be used to achieve protective grounding of the refrigeration system. The enclosure plate grounding structure can be implemented in a variety of ways. For example, the enclosure plate can at least partially protrude from the chassis 100 or the housing and electrically connected to a ground wire outside the containing space, or when the chassis 100 is also made of the metal material, the grounding is achieved by using the chassis 100 connected to the enclosure plate, or the enclosure plate is connected to a ground wire. In this way, the grounding of the heat exchanger 500 is achieved by screwing the enclosure plate made of the metal material to the metal side plate 501 of the heat exchanger 500, and the refrigeration system is electrically connected to the heat exchanger 500, to achieve the grounding of the refrigeration system, so that the complex grounding structure is omitted, the assembly is simple and the production cost is reduced.

The above mentioned is only an optional embodiment of the present application, not to limit the claimed scope of the present application. Any equivalent structural transformation made under the inventive concept of the present application by using the content of the specification and the drawings of the present application, or direct/indirect application in other related technical fields are included in the claimed scope of the patent of the present application.

What is claimed is:

1. An air conditioner housing assembly comprising:

a rectangular chassis comprising a front edge that extends vertically, a rear edge that extends vertically, and two side edges between the front edge and the rear edge that extend vertically;

an enclosure plate portion comprising:

a rear enclosure plate affixed to the rear edge and disposed vertically; and two side enclosure plates affixed to the two side edges in a one-to-one correspondence and disposed vertically; and a housing fixed to the enclosure plate portion, wherein:

the housing forms a containing space;

the enclosure plate portion is within the containing space;

the enclosure plate portion comprises one or more positioning portions;

the housing comprises one or more positioning fit portions; and the one or more positioning portions are mated with the one or more positioning fit portions in a one-to-one correspondence to position the housing relative the enclosure plate portion.

2. The air conditioner housing assembly according to claim 1, wherein:

the housing is made of a plastic material; and the enclosure plate portion is made of a metal material.

3. The air conditioner housing assembly according to claim 1, wherein:

the housing comprises an upper plate fixed to an upper side of the enclosure plate portion, a front plate fixed to the rectangular chassis and the two side enclosure plates of the enclosure plate portion, and a rear housing plate fixed to the rear enclosure plate of the enclosure plate portion;

left and right sides of the front plate comprise respective housing front plate side plates that extend rearward;

left and right sides of the rear housing plate comprises respective housing rear plate side plates that extend forward; and the housing front plate side plates are in abutment with the housing rear plate side plates in a one-to-one correspondence.

4. The air conditioner housing assembly according to claim 3, wherein:

the one or more positioning portions comprise respective first positioning slots at upper sides of the two side enclosure plates and one or more second positioning slots at an upper side of the rear enclosure plate;

the one or more positioning fit portions comprise respective positioning protrusions at left and right sides of the upper plate and one or more positioning studs provided at a rear side of the upper plate;

the positioning protrusions are matched with the first positioning slots in a one-to-one correspondence; and the positioning studs are matched with the second positioning slots in a one-to-one correspondence.

5. The air conditioner housing assembly according to claim 4, wherein the first positioning slots and the second positioning slots form v-shaped grooves with upward openings.

6. The air conditioner housing assembly according to claim 4, wherein:

left and right ends of the upper plate comprises respective positioning support members;

left and right ends of the rectangular chassis comprises respective positioning support members;

the housing front plate side plates comprise respective support fit members; and the positioning support members are matched with the support fit members in a one-to-one correspondence.

7. The air conditioner housing assembly according to claim 6, wherein the positioning support members are clamped to the support fit members.

8. The air conditioner housing assembly according to claim 6, wherein:

one of the housing front plate side plates and the housing rear plate side plates include respective clamping portions;

another of the housing front plate side plates and the housing rear plate side plates include respective clamping fit portions; and the clamping portions are matched with the clamping fit portions in a one-to-one correspondence.

9. The air conditioner housing assembly according to claim 8, wherein:

a front side of the upper plate comprises one or more positioning grooves;

at least one of the front plate or the rear housing plate comprises one or more positioning bumps; and the positioning bumps are mated with the positioning grooves in a one-to-one correspondence.

10. The air conditioner housing assembly according to claim 3, further comprising a spacer plate, wherein:

the spacer plate is provided in the containing space and fixed to the enclosure plate portion to divide the containing space into an upper containing cavity and a lower containing cavity;

one of the housing rear plate side plates is provided with a mounting port for a remote controller;

the spacer plate is provided with an avoidance groove corresponding to the mounting port;

one of the side enclosure plates is provided with an avoidance notch corresponding to the mounting port; and the rear enclosure plate is provided with the avoidance notch.

11. An air conditioner comprising the air conditioner housing assembly according to claim 1.

12. The air conditioner according to claim 11, wherein the air conditioner comprises a mobile air conditioner.

13. The air conditioner according to claim 12, further comprising respective metal side plates on left and right sides of the heat exchanger, wherein:

the side enclosure plates are made of a metal material;

metal side plates are attached to the side enclosure plates; and at least one of the side enclosure plates has a grounding structure.

* * * * *